US011239619B2

(12) United States Patent
Yu

(10) Patent No.: US 11,239,619 B2
(45) Date of Patent: Feb. 1, 2022

(54) WIRE CONNECTING DEVICE AND METHOD THEREOF

(71) Applicant: NINGBO WELL ELECTRIC APPLIANCE CO., LTD., Ningbo (CN)

(72) Inventor: Guolin Yu, Ningbo (CN)

(73) Assignee: NINGBO WELL ELECTRIC APPLIANCE CO., LTD., Ningbo (CN)

( * ) Notice: Subject to any disclaimer, the term of this patent is extended or adjusted under 35 U.S.C. 154(b) by 30 days.

(21) Appl. No.: 16/689,021

(22) Filed: Nov. 19, 2019

(65) Prior Publication Data

US 2021/0083443 A1 Mar. 18, 2021

(30) Foreign Application Priority Data

Sep. 17, 2019 (CN) ..... 201910876917.0

(51) Int. Cl.
*H01R 43/01* (2006.01)
*H01R 43/048* (2006.01)
*H01R 4/2495* (2018.01)

(52) U.S. Cl.
CPC ..... *H01R 43/01* (2013.01); *H01R 4/2495* (2013.01); *H01R 43/048* (2013.01)

(58) Field of Classification Search
CPC ..... H01R 4/2495; H01R 43/01; H01R 43/048
See application file for complete search history.

(56) References Cited

U.S. PATENT DOCUMENTS 3,804,971 A * 4/1974 Bazille, Jr. ..... H01R 4/2433 174/88 R
7,530,827 B2 * 5/2009 Caveney ..... H01R 4/2433 439/211
7,867,013 B2 * 1/2011 Cox ..... H01R 4/2433 439/404
8,062,056 B2 * 11/2011 Lee ..... H01R 4/2433 439/395
8,512,066 B2 * 8/2013 Lee ..... H01R 4/2433 439/395
9,577,353 B2 * 2/2017 Shi ..... H01R 4/2454
10,020,601 B1 * 7/2018 Hsu ..... H01R 9/031

FOREIGN PATENT DOCUMENTS

DE 202008004892 * 7/2008
DE 102010017265 A1 * 12/2011
EP 2608326 * 6/2018
GB 2 409 353 A * 6/2005

* cited by examiner

*Primary Examiner* — Carl J Arbes

(57) ABSTRACT

A wire connecting device for connecting and electrically communicating a first electrical wire and a second electrical wire can include: an electrical connector having a first end, a second end, and a concave portion between the first end and the second end, wherein the concave portion is configured for accommodating a second core wire of the second electrical wire; and a connecting member cooperating with the electrical connector and configured for guiding the first end and the second end of the electrical connector connected with the first electrical wire. A wire connection method using the wire connecting device can be further provided.

8 Claims, 3 Drawing Sheets

WIRE CONNECTING DEVICE AND METHOD THEREOF

CROSS-REFERENCE TO RELATED APPLICATIONS

This application claims all benefits accruing under 35 U.S.C. § 119 from China Patent Application No. 201910876917.0, filed on Sep. 17, 2019, in the CNIPA, the content of which is hereby incorporated by reference.

TECHNICAL FIELD

The present disclosure relates to the technical field of an electrical connection of two or more electrical wires, and in particular, to a wire connecting device and a method thereof.

BACKGROUND

A lamp holder can be used for assembling a bulb, which is electrically connected to the bulb, so that the bulb can illuminate. A power supply connected to the lamp holder usually includes three wires, which are respectively a live wire, a neutral wire and a ground wire. At present, for connecting the power supply with the lamp holder, an electrical connector such as a copper element can be used to connect a core wire of one electrical wire with a core wire of another electrical wire by crimping. However, before the crimping process, it is necessary to manually cut off an insulating housing of the electrical wire to be connected, and then crimp the core wires of the two electrical wires with the electrical connector, and finally integrally encapsulate a rubber on the crimped core wires.

Although the above method can realize an electrical connecting of the two electrical wires, a stability of manually cutting the insulating housing is poor, a cutting position may be unfixed, a cutting area may be uncontrollable, and even the core wire may be cut off, which is hard to realizing the electrical connection of the two electrical wires. In addition, it cannot be automated, resulting in low production efficiency.

SUMMARY

The present disclosure provides a wire connecting device and a method thereof.

The wire connecting device for connecting and electrically communicating a first electrical wire and a second electrical wire can include: an electrical connector having a first end, a second end, and a concave portion between the first end and the second end, wherein the concave portion is configured for accommodating a second core wire of the second electrical wire; and a connecting member cooperating with the electrical connector and configured for guiding the first end and the second end of the electrical connector connected with the first electrical wire.

In one embodiment, the connecting member can be provided with a lancet configured for piercing a first insulating housing of the first electrical wire to contact with a first core wire of the first electrical wire. A first guiding surface extending respectively from both sides of the lancet can be configured for guiding the first end and the second end of the electrical connector.

In one embodiment, the first guiding surface can have an arc shape.

In one embodiment, the first end of the electrical connector can be provided with at least one first spinous structure and the second end of the electrical connector can be provided with at least one second spinous structure.

In one embodiment, the at least one first spinous structure and the at least one second spinous structure may not be opposite to each other and may be a mismatch with each other.

In one embodiment, the connecting member can be provided with a transitional surface and a second guiding surface respectively extending outwards from the first guiding surface in order.

In one embodiment, the second guiding surface, the transitional surface and the first guiding surface can be configured for guiding the first end and the second end of the electrical connector to be deformed and crimped, resulting in electrically communicating the first end and the second end of the electrical connector with the first core wire.

In one embodiment, the wire connecting device can further include a pressing member, the pressing member and the connecting member are separated on opposite sides of the electrical connector. The pressing member can be configured for pressing the electrical connector and making the first end and the second end of the electrical connector guide by the second guiding surface, the transitional surface and the first guiding surface.

In one embodiment, the wire connecting device can further include a driving member configured for pushing the connecting member or the pressing member to make the electrical connector and the connecting member move towards each other.

A wire connection method using the wire connecting device can include:

providing the electrical connector and the connecting member;

placing the second core wire of the second electrical wire on the concave portion of the electrical connector, and placing the first electrical wire on an opening of the concave portion of the electrical connector; and engaging the electrical connector and the connecting member to make the first end and the second end of the electrical connector inserting into a first insulating housing of the first electrical wire, resulting in the first electrical wire and the second electrical wire electrically communicated by the electrical connector.

In the present disclosure, the wire connecting device and the method thereof have the following advantages.

The electrical connector is configured for directly connecting the second core wire of the second electrical wire with the first core wire of the first electrical wire, thereby avoiding a step of manually cutting off the insulating housing and the problems caused by cutting off the insulating housing. It can improve an efficiency and stability of the electrical connection of the two electrical wires. At the same time, the wire connecting device can be mechanically operated, which can realize an automation of the electrical connection of the two electrical wires.

DETAILED DESCRIPTION

The embodiments of the present disclosure are clearly and completely described in the following with reference to the accompanying drawings. The described embodiments of the present disclosure do not represent all embodiments. All other embodiments obtained by those skilled in the art based on the embodiments of the present disclosure without creative efforts are within the scope of the present disclosure.

All technical and scientific terms used herein have the same meaning as commonly understood by one skilled in the art to which this present disclosure belongs, except where it is specifically defined. The terminology used in the description of the present disclosure is for the purpose of describing particular embodiments and is not intended to limit the present disclosure.

Figure 1:
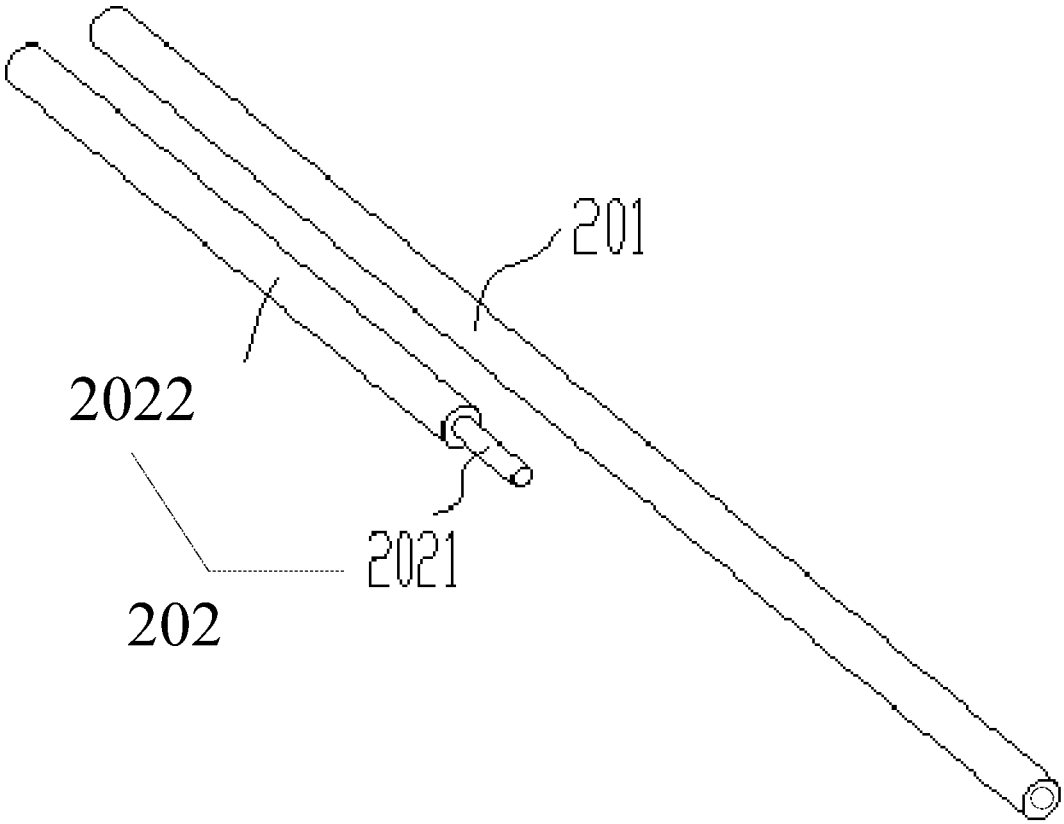
FIG. 1 is a perspective view of a first electrical wire and a second electrical wire to be connected in an embodiment of the present disclosure.
Figure 2:
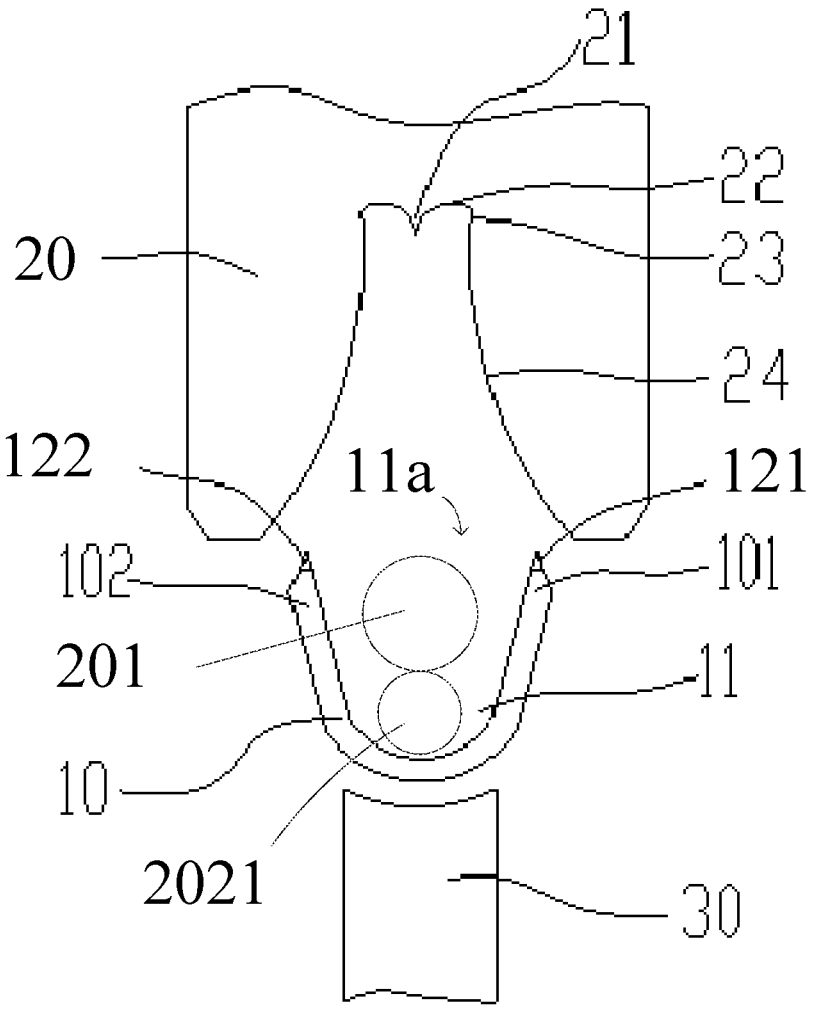
FIG. 2 is a perspective view of a wire connecting device in an embodiment of the present disclosure.
Figure 3:
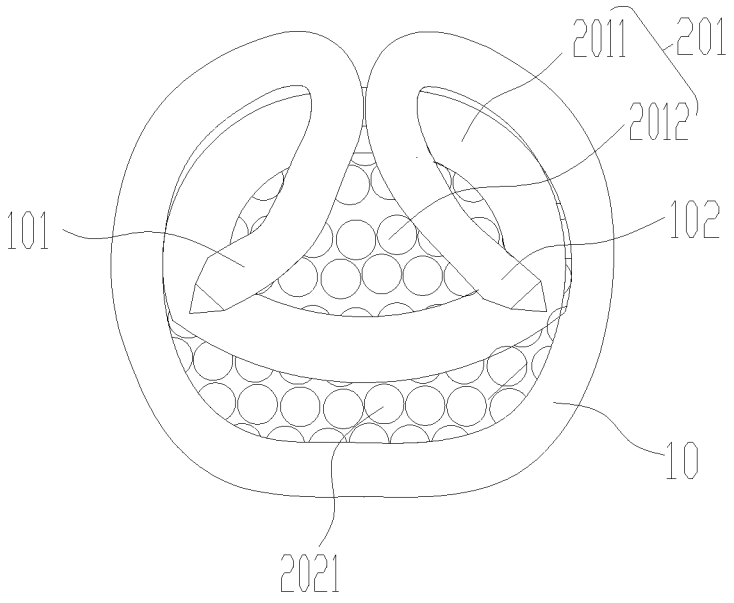
FIG. 3 is a cross-sectional view of a connected wire connecting device, a first electrical wire and a second electrical wire in an embodiment of the present disclosure.

Referring to FIG. 1 and FIG. 2, a wire connecting device or electrical connector 10 is provided in one embodiment in the present disclosure. The wire connecting device 10 can be configured for connecting (e.g., crimping) a first electrical wire 201 and a second electrical wire 202 and electrically communicating the first electrical wire 201 with the second electrical wire 202. Referring to FIG. 1 and FIG. 3, the first electrical wire 201 can include a first core wire 2012 and a first insulating housing 2011, and the second electrical wire 202 can include a second core wire 2022 and a second insulating housing 2021. In use, one end of the second core wire 2021 is exploded and not coated by the second core wire 2021, in order to connecting with the first electrical wire 201.

Referring to FIG. 2 and FIG. 3, the wire connecting device can include an electrical connector 10, a connecting member 20 and a pressing member 30. The electrical connector 10 can cooperate with the connecting member 20 and the pressing member 30 to connect the first electrical wire 201 to the second electrical wire 202, thereby realizing an electrical communication between the first electrical wire 201 and the second electrical wire 202.

The electrical connector 10 can have a first end 101, a second end 102, and a concave portion 11. The concave portion 11 can be configured for accommodating the second core wire 2021 of the second electrical wire 202. In an operation of the wire connecting device, the second core wire 2021 of the second electrical wire 202 can be disposed in a bottom of the concave portion 11 of the electrical connector 10, and the first electrical wire 201 can be placed on an opening 11*a* of the concave portion 11 of the electrical connector 10. The electrical connector 10 can have a small thickness and can be easily deformed under a pressure. The electrical connector 10 can be a copper sheet.

The connecting member 20 can be configured for cooperating with the electrical connector 10. The connecting member 20 can guide the first end 101 and the second end 102 of the electrical connector 10 to penetrate the first insulating housing 2011 of the first electrical wire 201, thereby realizing the electrical communication between the electrical connector 10 and the first electrical wire 201.

Referring to FIG. 2, the connecting member 20 can be provided with a lancet 21. The lancet 21 of the connecting member 20 can pierce the first insulating housing 2011 of the first electrical wire 201 and make contact with the first core wire 2012 of the first electric wire 201. The connecting member 20 can include a first guiding surface 22 extending respectively from both sides of the lancet 21. It should be noted that the connecting member 20 is not limited to the shape shown in FIG. 2. In another embodiment, the connecting member 20 does not include any lancet and only includes two first guiding surfaces 22 configured for guiding the first end 101 and the second end 102 of the electrical connector 10. In this case, an external tool can be provided to pierce the first insulating housing 2011 of the first electric wire 201.

When the electrical connector 10 is engaged with the connecting member 20, the lancet 21 of the connecting member 20 can pierce the first insulating housing 201 of the first electrical wire 201 and contact with the first core wire 2012 of the first electrical wire 201. The first end 101 and the second end 102 of the electrical connector 10 can respectively slide along the first guiding surface 22 until contacting with the first electrical wire 201 pierced by the lancet 21. In detail, under a guiding of the first guiding surface 22, the first end 101 and the second end 102 of the electrical connector 10 can be inserted into the first electrical wire 201 that has been pierced by the lancet 21, thereby achieving an electrical communication between the first end 101 and the first core wire 2012 and between the second end 102 and the first core wire 2012. The second core wire 2021 of the second electrical wire 202 which is disposed in the bottom of the concave portion 11 of the electrical connector 10 can be electrically connected with the electrical connector 10, resulting in realizing the electrical connection between the first electrical wire 201 and the second electrical wire 202 by the electrical connector 10. The first end 101 and the second end 102 of the electrical connector 10 are electrically connected to the first electrical wire 201. In one embodiment, the first end 101 and the second end 102 of the electrical connector 10 can be inserted into the first electrical wire 201 according to the use requirement. In another embodiment, the first end 101 and the second end 102 of the electrical connector 10 can be contacted with a surface of the first core wire 2012 of the first electrical wire 201, which may also satisfy the requirement of the electrically connection between the electrical connector 10 and the first electrical wire 201.

The pressing member 30 and the connecting member 20 can be separated from each other and located on two sides of the electrical connector 10. In this embodiment, one end of the pressing member 30 can abut against the concave portion 11 of the electrical connector 10. That is, the pressing member 30 can limit a location of the electrical connector 10 or can push the electrical connector 10 to cooperate with the connecting member 20.

The electrical wire connecting device of the present embodiment further includes a driving member (not shown). The driving member can push the connecting member 20 and/or the pressing member 30 so that the connecting member 20 and the pressing member 30 can move toward each other to engage the connecting member 20 with the electrical connector 10. That is, the driving member can be used as a power source for the connecting member 20 to cooperate with the electrical connector 10. The driving member can include a cylinder according to the use requirement, thereby realizing an automation of operating of the wire connection device as a whole. In another embodiment, one skilled in the art can also manually drive the connecting member 20 and/or the pressing member 30.

In another embodiment, a first spinous structure 121 can be provided on the first end 101 of the electrical connector 10, and a second spinous structure 122 can be provided on the second end 102 of the electrical connector 10, such that the first end 101 and the second end 102 of the electrical connector 10 can be conveniently inserted into the first electrical wire 201 pierced by the lancet 21.

In another embodiment, the first end 101 and the second end 102 of the electrical connector 10 can be respectively provided with a plurality of first spinous structure 121 and a plurality of second spinous structure 122. The plurality of first spinous structure 121 and the plurality of second spinous structure 122 are not opposite to each other and mismatch with each other, so that the plurality of first spinous structure 121 and the plurality of second spinous structure 122 can be inserted into the first electric wire 201 in a misaligned manner. In final, the first end 101 and the second end 102 of the 10 can be easily inserted into the first electrical wire 201 pierced by the lancet 21.

Further, the plurality of first spinous structure 121, the plurality of second spinous structure 122 and the electrical connector 10 can be an integrity structure.

The first guiding surface 22 of the connecting member 20 can be in an arc shape so as to guide the first end 101 and the second end 102 of the electrical connector 10 along the first guiding surface 22 to insert into the first electrical wire 201.

In another embodiment, the connecting member 20 can be further provided with a transitional surface 23 and a second guiding surface 24 extending outwards from the first guiding surface 22. The two transitional surfaces 23 can press the electrical connector 10 and make the electrical connector 10 connected or crimped onto the second core wire 2021 and the first core wire 2012. That is, when matching the connecting member with the electrical connector 10, the electrical connector 10, the second core wire 2021 of the second electrical wire 202, and the first electrical wire 201 can be crimped and fixed. The first end 101 and the second end 102 of the electrical connector 10 can firstly abuts against the two transitional surfaces 23 and the two first guiding surfaces 22 subsequently, so that the transitional surface 23 can press the electrical connector 10 and have a function of guiding the first end 101 and the second end 102 of the electrical connector 10 at the same time.

The second guiding surface 24, the transitional surface 23 and the first guiding surface 22 can be configured for guiding the first end 101 and the second end 102 of the electrical connector 10 to be deformed and crimped, resulting in electrically communicating the first end 101 and the second end 102 of the electrical connector 10 with the first core wire 2012. The second guiding surface 24, the transitional surface 23 and the first guiding surface 22 can be smoothly connected, so that the first end 101 and the second end 102 of the electrical connector 10 can be crimped gradually from the second guiding surface 24 to the first guiding surface 22.

The present disclosure further provides a wire connection method using the wire connecting device comprising the following steps:

(1) providing the electrical connector 10 and the connecting member 20, wherein the electrical connector 10 having the first end 101, the second end 102, and the concave portion 11 between the first end 101 and the second end 102, the concave portion 11 can be configured for accommodating the second core wire 2021 of the second electrical wire 202, the connecting member 20 can cooperate with the electrical connector 10 and be configured for guiding the first end 101 and the second end 102 of the electrical connector 10 connected with the first electrical wire 201;

(2) placing the second core wire 2021 of the second electrical wire 202 on the concave portion 11 of the electrical connector 10, and placing the first electrical wire 201 on an opening 11*a* of the concave portion 11 of the electrical connector 10;

(3) engaging the electrical connector 10 and the connecting member 20 to make the first end 101 and the second end 102 of the electrical connector 10 inserting into the first insulating housing 2011 of the first electrical wire 201, resulting in the first electrical wire 201 and the second electrical wire 202 electrically communicated by the electrical connector 10.

In summary, the electrical connector 10 is configured for directly connecting the second core wire 2021 of the second electrical wire 202 with the first core wire 2012 of the first electrical wire 201, thereby avoiding a step of manually cutting off the insulating housing and the problems caused by cutting off the insulating housing. It can improve an efficiency and stability of the electrical connection of the two electrical wires. At the same time, the wire connecting device can be mechanically operated, which can realize an automation of the electrical connection of the two electrical wires.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A wire connection method using a wire connecting device, wherein the wire connecting device is configured for connecting and electrically communicating a first electrical wire and a second electrical wire, the wire connecting device comprising:

an electrical connector having a first end, a second end, and a concave portion between the first end and the second end, wherein the concave portion is configured for accommodating a second core wire of the second electrical wire; and a connecting member cooperating with the electrical connector and configured for guiding the first end and the second end of the electrical connector connected with the first electrical wire, the connecting member is provided with a lancet configured for piercing the first insulating housing of the first electrical wire to contact with a first core wire of the first electrical wire, a first guiding surface extending respectively from both sides of the lancet is configured for guiding the first end and the second end of the electrical connector, the method, comprising:

providing the electrical connector and the connecting member;

placing the second core wire of the second electrical wire on the concave portion of the electrical connector, and placing the first electrical wire on an opening of the concave portion of the electrical connector; and engaging the electrical connector and the connecting member to make the first end and the second end of the electrical connector inserting into a first insulating housing of the first electrical wire, resulting in the first electrical wire and the second electrical wire electrically communicated by the electrical connector.

2. The method of claim 1, wherein the first guiding surface is in an arc shape.

3. The method of claim 1, wherein the first end of the electrical connector is provided with at least one first spinous structure and the second end of the electrical connector is provided with at least one second spinous structure.

4. The method of claim 3, wherein the at least one first spinous structure and the at least one second spinous structure are not opposite to each other and mismatch with each other.

5. The method of claim 1, wherein the connecting member is provided with a transitional surface and a second guiding surface respectively extending outwards from the first guiding surface in order.

6. The method of claim 1, wherein the second guiding surface, the transitional surface and the first guiding surface are configured for guiding the first end and the second end of the electrical connector to be deformed and crimped, resulting in electrically communicating the first end and the second end of the electrical connector with the first core wire.

7. The method of claim 6, further comprising a pressing member, the pressing member and the connecting member are separated on opposite sides of the electrical connector, wherein the pressing member is configured for pressing the electrical connector and making the first end and the second end of the electrical connector guide by the second guiding surface, the transitional surface and the first guiding surface.

8. The method of claim 7, further comprising a driving member configured for pushing the connecting member or the pressing member to make the electrical connector and the connecting member move towards each other.

* * * * *